United States Patent [19]

Bonniaud et al.

[11] Patent Number: 4,571,307

[45] Date of Patent: Feb. 18, 1986

[54] PROCESS FOR CONDITIONING RADIOACTIVE WASTE

[75] Inventors: Roger Bonniaud, Goudargues; Antoine Jouan, Bagnols sur Ceze; Yves Héry, Orange, all of France

[73] Assignee: Commissariat a l'Energie Atomique, Paris, France

[21] Appl. No.: 563,307

[22] Filed: Dec. 19, 1983

[30] Foreign Application Priority Data

Dec. 23, 1982 [FR] France ..... 82 21665

[51] Int. Cl.[4] ..... G21F 9/16

[52] U.S. Cl. ..... 252/628; 252/629; 252/632

[58] Field of Search ..... 252/632, 631, 629, 628, 252/626, 633; 423/2, 5

[56] References Cited

U.S. PATENT DOCUMENTS

| | | | |
|---|---|---|---|
| 3,152,984 | 10/1964 | Winsche et al. | 252/632 |
| 3,778,295 | 12/1973 | Smith et al. | 252/628 |
| 3,787,321 | 1/1974 | Dahlen et al. | 252/632 |
| 4,040,973 | 8/1977 | Szivos et al. | 252/632 |
| 4,072,501 | 2/1978 | Quinby | 252/629 |
| 4,124,802 | 11/1978 | Terasawa et al. | 252/628 |
| 4,209,421 | 6/1980 | Heimer et al. | 252/632 |
| 4,379,082 | 4/1983 | Gauchon | 252/631 |
| 4,383,944 | 5/1983 | Ondracek | 252/628 |
| 4,407,742 | 10/1983 | Hrovat et al. | 252/628 |
| 4,409,137 | 10/1983 | Mergan et al. | 252/632 |

FOREIGN PATENT DOCUMENTS

| | | | |
|---|---|---|---|
| 0093554 | 11/1983 | European Pat. Off. | 252/628 |
| 2143929 | 2/1973 | France . | |
| 2175154 | 10/1973 | France . | |
| 2445594 | 7/1980 | France . | |
| 0130800 | 10/1979 | Japan | 252/628 |
| 0130798 | 10/1979 | Japan | 252/628 |
| 1446016 | 8/1976 | United Kingdom | 252/628 |

*Primary Examiner*—Stephen J. Lechert, Jr.
*Assistant Examiner*—Howard J. Locker
*Attorney, Agent, or Firm*—Michael N. Meller

[57] ABSTRACT

Process for the conditioning of waste constituted by radioactive metal particles insoluble in nitric acid solutions, wherein said particles are suspended in a liquid, the suspension undergoes an evaporation heat treatment by injecting the suspension onto a hot bed of a powder of a metal or an alloy chosen from the group including copper, nickel, zinc, copper alloys, nickel alloys, zinc alloys and stainless steel, and the dry mixture of powder and metal particles obtained after this heat treatment undergoes a melting process at a temperature adequate for melting the metal or alloy powder and for forming clearly defined compounds between the metal of the powder and at least part of the metal constituents of the radioactive particles.

13 Claims, 1 Drawing Figure

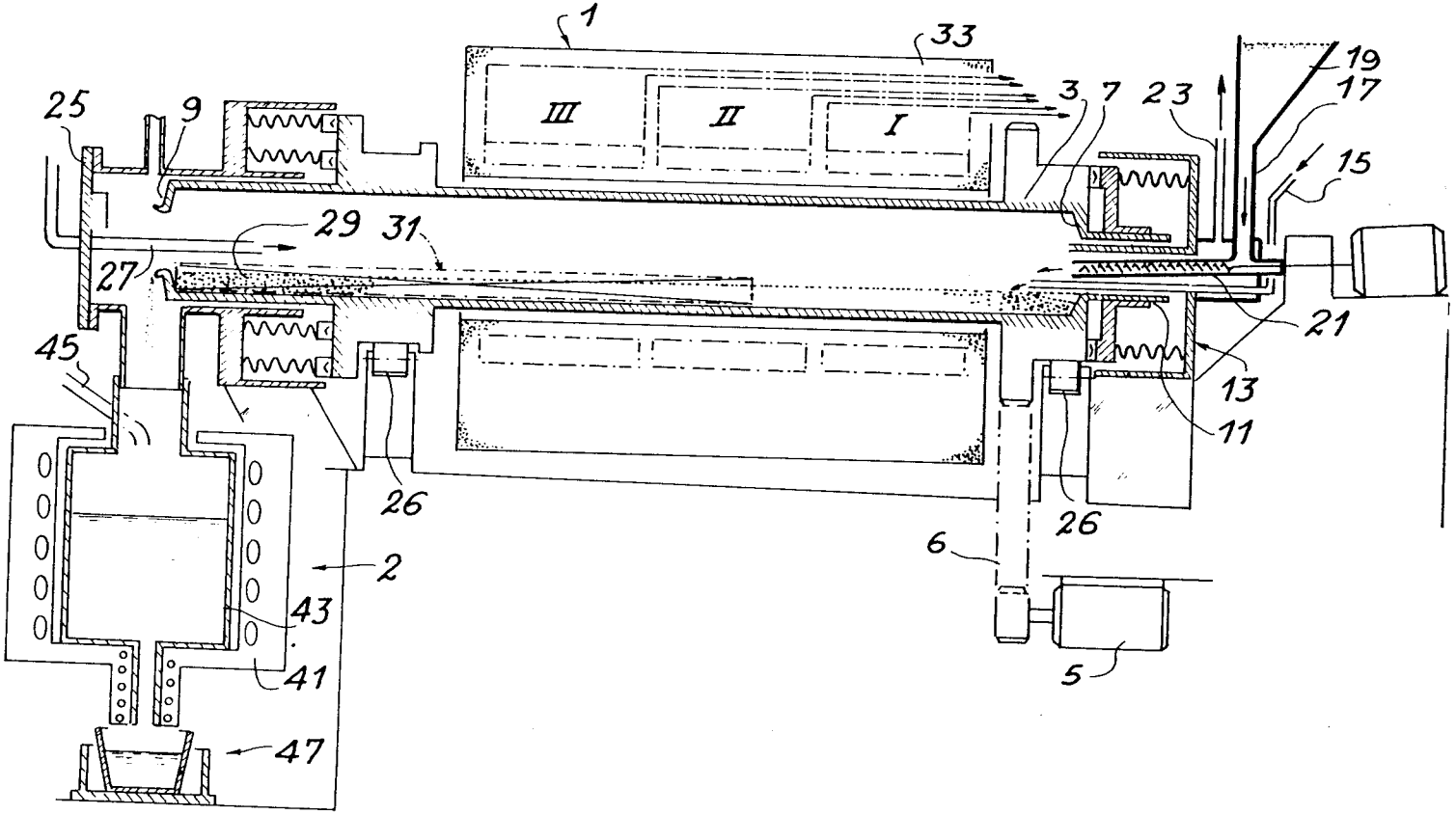
19
17
15
21
13
11
23
7
3
33
I
II
III
1
26
5
6
31
29
9
25
27
45
2
43
41
47

PROCESS FOR CONDITIONING RADIOACTIVE WASTE

BACKGROUND OF THE INVENTION

The present invention relates to a process for conditioning waste, constituted by radioactive metal particles, such as fines obtained during the dissolving of irradiated fuel elements and dust obtained during the mechanical decanning and/or cutting up operations of irradiated fuel elements.

In installations for the reprocessing of irradiated nuclear fuel elements, the conventional practice consists of firstly subjecting the fuel elements to a preparatory mechanical treatment carried out e.g. by cutting up or shearing, with a view to facilitating the subsequent dissolving of the fuel in a nitric acid solution. During this operation, it is difficult to avoid the formation of dust and such radioactive metallic dust is largely insoluble in the solutions used for the reprocessing, so that they must be recovered and undergo conditioning. In the same way, during the dissolving of fuel elements, certain metal particles are not attacked, because they are insoluble in nitric acid solution and constitute what is generally called "dissolving fines". The latter are essentially constituted by ruthenium, rhodium, palladium, molybdenum and to a lesser extent by zirconium, niobium, technetium, uranium and plutonium. For example, the attached table gives the nature and composition of the dissolving and shearing fines from light water reactors and fast neutron reactors.

These metal particles form highly radioactive waste, which is difficult to valorize on a short term basis, despite the presence of a significant quantity of metals in the platinum group.

In addition, it is necessary to treat the waste in order to ensure that it is stored in the long term under satisfactory safety conditions.

In view of the fact that the quantity and dimensions of these insoluble radioactive particles increase with the irradiation level, the problem of processing such waste increases in importance with the development of light water reactors and fast neutron reactors, whose fuel elements are subject to high specific burn-ups.

Thus, it is estimated that the processing of one ton of uranium from light water reactor fuels gives approximately 3.5 kg of dissolving fines and that a ton of oxide from fast neutron reactor fuel elements gives 8 to 13 kg of dissolving fines.

Moreover, on taking as an order of magnitude, a reprocessing plant having a capacity of 800 t/year for light water reactor fuels, it would be necessary to process 2800 kg of such fines every year, whilst in the case of a reprocessing plant with a capacity of 150 t/year for fast neutron reactor fuels, there would be 1200 kg of fines per year. Moreover, it is necessary to add to these figures the dust obtained during the shearing and cutting up of the fuels. In the case of light water reactor fuels, the can is made from zircalloy and generally approximately 3 kg/t of shearing fines are produced. In the case of fast neutron reactor fuel elements for which the can is generally made from stainless steel, these shearing fines represent approximately 1 kg/t of uranium.

However, the processing of dissolving and shearing fines causes certain problems, due to their high thermal power linked with their high radioactivity, and in certain cases due to their pyrophoric character, due to the presence of fine zirconium particles resulting from the shearing of light water reactor fuel element cans.

Moreover, it is preferable to process these dissolving and shearing fines in the first stages of the fuel reprocessing process in order to prevent blockages to the pipes because, as the particles have high specific gravities, there is a tendency for them to be deposited in the calm areas of the installation. This also applies in connection with the prevention of local overheating, which causes premature damage to the containers, as well as the decomposition of organic solvents by radiolysis.

Consideration is also given to the separation and recovery of these fines at the outlet from the dissolving installation, so that they can be treated with a view to their conditioning.

Hitherto, for the conditioning of radioactive products, use has been made of various processes, the most important of which involves the coating of the waste in cement, or the vitrification thereof. However, these known processes are limited, when it is a question of conditioning radioactive waste constituted by dissolving or shearing fines. Thus, in the case of cements, the high specific power of the fines is prejudicial to the mechanical behavior of the coating material. Moreover, there are risks of radiolysis of the constitution water of the cement.

The incorporation of these particles into a glass is only possible after the irradiated fuel has been cooled for an adequate time. This serves to prevent the formation within the material of hot points, which favor a heterogeneous crystallization development and incipient cracks. This is why the process, which can be used for conditioning fines from PWR fuels, which are generally reprocessed after several years cooling, is not suitable for conditioning fines from fast neutron reactor fuel, which is generally reprocessed relatively rapidly after unloading from the reactor.

Consideration has also been given to the conditioning of the radioactive waste constituted by particles of oxides or glasses obtained from the solutions, by using metal matrixes, as described in French Pat. No. 2 387 093 and British Pat. No. 1 446 016. However, the products obtained as a result of these processes have a heterogeneous structure, the radioactive glass or oxide particles being dispersed in the metal matrix. Moreover, the process described in French Pat. No. 2 387 093 implies the preparation of a finely divided powder from a solution of radioactive waste containing a salt of the metal forming the matrix, following by a hot compression stage.

Thus, this process cannot be used for processing dissolving fines, because it leads to the formation of a ceramic-metal, which has the same disadvantages as glass from the thermal standpoint. Moreover, the mixture of very high-energy fines in an oxide, which is a poor heat conductor, leads to significant temperature rises in the mixture, to an agglomeration of the mixture and to the impossibility of obtaining a fine powder for fritting.

In the same way, the process of British Pat. No. 1 446 016 is not suitable for processing dissolving fines because, in view of the very small dimensions of such fines, it is impossible to obtain a homogeneous dispersion thereof in the metal matrix by pouring the same into a container containing the dissolving fines. Thus, the products obtained would not have satisfactory characteristics for long-term storage.

SUMMARY OF THE INVENTION

The present invention relates to a process for the conditioning of radioactive waste constituted by dissolving fines and/or cutting up and/or mechanical decanning fines, which obviates the disadvantages of the hitherto known processes.

The invention therefore specifically relates to a process for the conditioning of waste constituted by radioactive metal particles insoluble in nitric acid solutions, wherein said particles are suspended in a liquid, the suspension undergoes an evaporation heat treatment by injecting the suspension onto a hot bed of a powder of a metal or an alloy chosen from the group including copper, nickel, zinc, copper alloys, nickel alloys, zinc alloys and stainless steel, and the dry mixture of powder and metal particles obtained after this heat treatment undergoes a melting process at a temperature adequate for melting the metal or alloy powder and for forming clearly defined compounds between the metal of the powder and at least part of the metal constituents of the radioactive particles.

According to the invention, use is made of a metal or alloy powder for fixing, by chemical bonding in the form of clearly defined compounds, the metal constituents of the radioactive particles which offers numerous advantages.

Thus, the choice of a metal or an alloy as the material for fixing the radioactive waste makes it possible to solve the problems caused by the elimination of the heat of the radioactive particles, because metals have a good thermal conductivity, which is not the case with cement, glass and cermets in which are developed significant temperature gradients which can lead to the appearance of cracks and to an increase in the leaching rate, because the latter increases with temperature. Moreover, as a result of the good thermal conductivity of metals, it is possible to increase the level of fixed radioactive particles and consequently reduce the conditioning volume. However, it is normal to limit to 10% by weight the level of the radioactive particles fixed in the blocks obtained after the solidification of the mixture.

Moreover, the choice according to the invention, of a powder of copper, nickel, zinc, copper alloy, nickel alloy, zinc alloy or stainless steel for forming the fixing medium for the radioactive waste makes it possible to obtain products which better retain the said waste and which also have satisfactory performance characteristics over a period of time. Thus, these materials are able to form clearly defined compounds with most of the radioactive metal constituents of the waste particles. Thus when using a copper powder, rhodium, which is the most radioactive of the mixture of fines to be processed, forms a clearly defined compound with copper, which is solubilized in the matrix giving an alloy constituted by a solid Cu-Rh solution. The same is the case with regards to palladium and zirconium. The use of cupronickel makes it possible to obtain a solid solution with the fission molybdenum.

With regards to the time behavior, it is known that copper, nickel, zinc and their alloys, as well as stainless steel, have a better time behavior than cement or glasses, which makes it possible to ensure a better confinement of the radioactive waste, limit the exchange surface with the surrounding medium and prevent risks of cracking, which are considerable in the case of cement or glass matrixes. Moreover, on appropriately choosing the metal powder used, it is possible to subsequently recover certain constituents, particularly the platinoids, following deactivation. Thus, in the case of copper, this can be carried out by subjecting the waste conditions in the copper, following deactivation, to a chemical treatment for the selective dissolving of the copper.

According to the invention, preference is given to the use of a copper or copper alloy powder, e.g. bronze, cupronickel, or an alloy of copper and zirconium.

Generally, for performing the process according to the invention, the dissolving fines of the irradiated fuels and the shearing fines are suspended in a liquid, such as water. For recovering these fines after dissolving the irradiated fuels, the dissolving solution undergoes clarification, using either a centrifugal decanter, or a pulsed filter.

The thus separated fines are then washed and suspended in a stream of water. The suspension is then stored in appropriate containers, prior to treatment by the process according to the invention.

Bearing in mind the acidity of the dissolving solution, from which the fines have been recovered, the suspension obtained is generally acid and can have an approximately 0.8N nitric acidity.

For performing the process according to the invention, the suspension of radioactive particles undergoes an evaporation heat treatment by injecting the suspension onto a hot bed of metal or alloy powder forming the fixing medium. Thus, there is simultaneously an evaporation of the suspension liquid and a homogeneous mixing of the radioactive particles with the metal or alloy powder of the bed, which is preferably kept in motion during this heat treatment.

Advantageously the treatment is carried out in a substantially horizontal tube, which is heated and rotated about an axis and which contains the metal or alloy powder bed. Preferably, this tube also has means such as a scraper for preventing the sticking of powder particles to the tube wall. This scraper can be constituted by a loose bar having a starlike section, which bears on the tube in the metal or alloy powder bed.

When use is made of a rotary tube containing the metal or alloy powder bed, the suspension of radioactive particles and the metal or alloy powder is advantageously reduced at one of the ends of the heated tube and which is rotated about its axis, and at the other end of said tube is recovered the dry mixture, which is then transferred into a melting furnace.

It is therefore possible to operate on a continuous basis, by forming in the rotary tube a dry material bed, onto which is introduced controlled flows of the suspension of radioactive particles and metal and alloy powder.

In order to obtain a homogeneous mixture of the radioactive particles and the metal or alloy powder of the bed during the evaporation heat treatment, it is advantageous to use a metal or alloy powder having a grain size between 100 and 500 $\mu$m and preferably a tortuous or warped surface in order to facilitate the mechanical attachment of radioactive particles to the powder, because as a result of their small size (0.3 to 15 $\mu$m), there would be a danger of the particles being entrained by the gases circulating in the apparatus used for the evaporation heat treatment.

Moreover, in order to obtain a homogeneous mixture satisfactorily fixing the radioactive particles, the metal or alloy powder volume is chosen in such a way relative to the volume of the radioactive particles to be treated, that a block having satisfactory qualities is obtained after solidification. Generally, the volume ratio between the metal and alloy powder on the one hand and the radioactive particles on the other is 10, but the heat conditions (heat given off by the ingot produced, cooling conditions, etc.) can lead to this ratio being modified, e.g. doubled.

The apparatus used for carrying out the evaporation heat treatment can in particular be a calcinator, as described in French Pat. No. 2 262 854, filed on 28.2.1974 by the Commissariat a l'Energie Atomique.

Preferably and particularly when the initial aqueous suspension has a certain acidity and the metal or alloy powder used can be oxidized by this acid solution, the dry mixture of powder and metal particles obtained as a result of the evaporation treatment, undergoes a reduction treatment by hydrogen prior to melting. This reduction treatment can be carried out in the rotary tube containing the metal or alloy powder bed. Therefore the rotary tube has at least two areas heated to different temperatures and a gaseous reducing mixture constituted e.g. by argon or nitrogen to which hydrogen has been added is circulated in the rotary tube in countercurrent with respect to the suspension and the metal or alloy powder bed. Thus, evaporation takes place in the first area of the tube and the evaporation treatment is completed by a reduction treatment in the second area of the tube, in order to reduce the oxides which may be formed during the evaporation heat treatment.

The dry mixture obtained then undergoes melting. This can be carried out in an induction furnace under vacuum or under a controlled atmosphere, e.g. under a hydrogen-containing argon atmosphere.

Advantageously, the dry mixture obtained at the outlet from the rotary tube is directly transferred into the melting furnace, by making it flow by gravity into the furnace crucible and melting takes place at between 1100° and 1500° C. In the case where a copper powder is used, a liquid bath is generally obtained by heating the mixture to a temperature between 1300° and 1500° C. After melting, the liquid bath is poured into an ingot mold. In this way a metal ingot is obtained, in which the different radioactive constitutents of the fines are alloyed or dispersed.

In certain cases, in order to improve the surface state of the ingot obtained, it is possible to add to the liquid bath a flux constituted e.g. by glass frit for the purpose of digesting the remaining oxides resulting from the surface oxidation of the metal or alloy powder by water vapor. After separation of the glass during cooling, an ingot with good surface characteristics is obtained.

During the evaporation heat treatment performed in the rotary tube, the vapors and gases escaping from this tube may entrain the radioactive particles which must be separated. Advantageously the dust entrained by the vapors released during the evaporation heat treatment is recovered, e.g. by washing the gases and vapors. This dust is then recycled into the suspension of radioactive particles to be treated.

For the performance of the process according to the invention, advantageously the evaporation heat treatment is carried out by heating the rotary tube to between 250° and 450° C. and by operating under a pressure below atmospheric pressure.

DESCRIPTION OF THE DRAWING AND THE PREFERRED EMBODIMENTS

Other features and advantages of the invention can be gathered from the following description relative to preferred, but nonlimitative embodiments and with reference to the attached drawing, which shows a vertical section through an apparatus for performing the process according to the invention.

It is possible to see that the apparatus for conditioning the radioactive waste in particle form, comprises an evaporation system 1 and a melting furnace 2. System 1 comprises a tube 3 made, for example, from an alloy marketed under the trademark URANUS, which can be rotated about an axis by means of a geared electric motor 5, via a chain and gear system 6. The rotary tube 3 can be arranged either horizontally, or in such a way that its axis slopes slightly, e.g. by about 3% relative to the horizontal. Its ends are provided with flanges 7 and 9. A ferrule 11 is fixed to flange 7 and a sealing device 13 is fitted around the ferrule 11, in order to tightly seal one of the ends of the tube during its rotation. A pipe 15 connected to a not shown suspension tank passes through the end fitting 13 and issues at the end of tube 3, making it possible to introduce into the latter with the desired flow rate, the suspension of radioactive particles. A pipe 17 connected to a funnel or hopper 19 filled with the metal or alloy powder also passes through the end fitting 13 and issues into tube 3. Pipe 17 is provided with a feed screw 21 and it makes it possible to introduce the metal powder into tube 3 at the desired flow rate. End fitting 13 is also traversed by a gas discharge pipe 23. The latter then passes through a not shown dust removal installation, in which the entrained radioactive particles are recovered by gas washing. The thus recovered particles are then recycled into the suspension tank associated with pipe 15.

At its other end, tube 3 is sealed by a fixed sealing fitting 25, incorporating a system for the tight connection to the melting furnace 2.

At each of its ends, tube 3 is supported by rollers 26, so that the tube is supported when it is either in its fixed position, or when rotating. A pipe 27 passes through end fitting 25 for the purpose of circulating in tube 3 a gas such as argon containing 5% of hydrogen in countercurrent with respect to the powder bed 29 circulating in tube 3. A scraper 31 formed by a loose bar having a starlike section makes it possible to prevent powder particles from sticking to the walls of tube 3 during the heat treatment. For carrying out the heat treatment, the tube is arranged in a furnace 33 having three heating zones I, II and III, so that the corresponding areas of tube 3 can be raised to different temperatures.

The melting installation 2 comprises an induction furnace 41, in which is arranged a crucible 43 receiving the dry mixture of powder and metal particles from tube 3, which is transferred by gravity through the opening provided for this purpose in flange 9. A pipe 45 issues into the interior of the melting crucible, for introducing into the latter a neutral or reducing gas, such as hydrogenated argon, in order to protect the bed in the crucible and force the vapors towards end fitting 13. After melting the molten bath flows into the ingot mold 47.

Hereinafter, an exemplified embodiment of the process of the invention is described using the apparatus described hereinbefore with a 30 cm diameter and a 80 cm length rotary tube.

A suspension containing 50 g/l of dissolving fines with a grain size of approximately a few microns is agitated in the storage tank associated with pipe 15. The suspension is introduced into the rotary tube 3 by pipe 15 at a flow rate of 5 l/h, which corresponds to the introduction of 250 g/h of fines. 2.5 kg/h of copper powder with a grain size between 500 and 100 μm are also introduced into tube 3 by transfer screw 21. A neutral gas containing hydrogen for carrying out the evaporation under a neutral argon or nitrogen atmosphere is introduced by tube 27. The rotation of tube 3 is regulated to a speed of approximately 5 r.p.m. and zones I and II are heated to a temperature of 45° C. and zone III to a temperature of approximately 350° C.

Under these conditions, within tube 3 is formed a powder bed 29 with a thickness of approximately 3 cm and weighing approximately 13 kg, which spends approximately 5 hours in the tube. The bed temperature rises to 80°, 195° and 250° C. in the zones corresponding respectively to the heating zones I, II and III and the water vapor is evacuated with the scavenging gas by pipe 23, whilst the dry product flows by gravity into crucible 43 of melting installation 2.

When the crucible contains 20 to 40 kg of product, the supply to tube 3 is interrupted in order to pass through the melting phase. This can take approximately 90 minutes, when operating under 23 KW. After melting the liquid bath is poured into ingot mold 47. In this way 20 to 40 kg ingots are obtained, which have satisfactory properties.

In other tests, use was made of a stainless steel powder having a grain size between 150 and 300 μm, which was introduced into tube 3 at a flow rate of 2 kg/h. Under the same operating conditions, a satisfactory mixture of fines with the stainless steel powder is obtained and by melting at about 1500° C., ingots with satisfactory properties are obtained.

In order to optimize the solubilization of the molybdenum of the fines, use was made of a cupronickel powder containing for certain tests 80% copper and 20% nickel, and for other tests 60% copper and 40% nickel. After melting, ingots were obtained, whose analysis confirms the formation of a solid solution with molybdenum.

Although the drawing shows a melting installation operating in an intermittent manner, it is also possible to use a continuous melting installation, the metal flow being ensured by a continuous pouring nozzle.

Tests carried with other waste constituted by radioactive metal particles demonstrated that satisfactory results could be obtained when starting with copper powders or stainless steel powders with grain sizes between 40 μm and 1.25 mm the most suitable range being 100 to 500 μm, by circulating argon containing 5% hydrogen at a flow rate of 800 l/h in tube 3 and by heating zones I, II and III of tube 3 at temperatures of 300° to 500° C. with a tube rotation speed of 5 to 15 t/min and with the product spending approximately 5 hours in tube 3.

When copper powder is used as the metal powder, it is necessary to prevent oxidation of the copper and to operate in the presence of hydrogen for reducing any possibly formed oxides in the final zone of tube 3.

TABLE

| | Light water reactor 33,000 MW/d/t | | | | Fast neutron reactor | | | |
|---|---|---|---|---|---|---|---|---|
| Shearing fines | | | | | | | | |
| Nature | Zr | | | | Stainless steel | | | |
| Quantity | 3.5 kg/t (doubtless in excess) | | | | 1 kg/t of U | | | |
| Grain size | depends on shearing | | | | 1 kg/t of U | | | |
| Dissolving fines | | | | | | | | |
| Nature | Ru 42% | Rh 15.5% | | | Ru 30% | Rh 9% | | |
| | Mo 11% | Tc 3% | | | Mo 12% | Tc 3% | | |
| | Pd 20% | U 3% | | | Pd 20% | Zr.Nb 5% | | |
| | | Pu 0.5% | | | | | | |
| Quantity | 3.1 kg/t | | | | 8 kg/t U for 60,000 MW/d/t<br>9.7 kg/t U for 70,000 MW/d/t<br>13.1 kg/t U for 100,000 MW/d/t | | | |
| Grain size | 0.3 to 0.4μ (average)<br>90% 0.6μ (colloidal size) | | | | 60 to 80% between 0.8 and 15μ<br>10 to 20% 1.5μ<br>= 20% 0.6μ | | | |
| Density | d 5.6 ± 0.3 to 30° C. | | | | d = 6.1 to 6.7 | | | |
| Apparent volume | | | | | 0.2 litr/kg after sedimentation | | | |
| | | | | | Average core 70,000 MW/d/t | | | |
| Activity (Ci/t) and specific power W/t | 0.5 · | 51,680 | (Ci/t) | 2,353 W/t | 0.5 · | $1.69 \cdot 10^6$ | Ci/t | 7,645 W/t |
| | 1.5 · | 282,949 | | 1,367 | 1 · | 991,650 | | 4,795 |
| | 2.5 · | 139,186 | | 675 | 2 · | 489,428 | | 2,377 |
| | 3.5 · | 70,915 | | 341 | 3 · | 246,462 | | 1,197 |
| | 5.5 · | 18,053 | | 87 | 5 · | 63,833 | | 305 |
| | 7 · | 4,657 | | 22 | 7 · | 16,181 | | 79 |
| | 10 · | 650 | | 3 | 10 · | 2,169 | | 10.3 |

What is claimed is:

1. A process for the conditioning of waste constituted by radioactive metal particles insoluble in nitric acid solutions, comprising the steps of suspending said particles in a liquid, subjecting the suspension to an evaporation heat treatment by injecting the suspension onto a hot bed of a powder of a metal or an alloy selected from the group consisting of copper, nickel, zinc, copper alloys, nickel alloys, zinc alloys and stainless steel, to form a dry mixture of powder said and metal particles and melting said dry mixture at a temperature sufficient to melt the metal or alloy powder and to form clearly defined compounds between the metal of the powder and at least part of the metal constituents of the radioactive particles.

2. A process according to claim 1, wherein the dry mixture of powder and metal particles obtained after the evaporation heat treatment undergoes reduction treatment by hydrogen, prior to melting.

3. A process according to claim 1, wherein the metal or alloy powder bed is in motion during the evaporation heat treatment.

4. A process according to claim 1, wherein the evaporation heat treatment of the suspension is carried out in a heated, substantially horizontal tube, which is rotated about its axis and which contains the metal or alloy powder bed.

5. A process according to claim 4, wherein the suspension of radioactive metal particles and the metal or alloy powder is introduced into one of the ends of the tube, wherein the dry mixture obtained is recovered at the other end of the tube, and wherein it is transferred into a melting furnace.

6. A process according to claim 2, wherein the reduction treatment is performed in a rotary tube by establishing therein at least two zones heated to different temperatures and by circulating a reducing gas mixture in countercurrent with the suspension and the bed.

7. A process according to claim 6, wherein the gaseous mixture is argon or nitrogen to which hydrogen has been added.

8. A process according to claim 1, wherein the dust entrained by the vapors given off during the evaporation heat treatment is recovered and said dust is recycled into the suspension of radioactive particles to be treated.

9. A process according to claim 1, wherein the metal or alloy powder has a grain size of 40 μm to 1.25 mm.

10. A process according to claim 9, wherein the metal or alloy powder has a grain size of 100 to 500 μm.

11. A process according to claim 1, wherein the said powder is a copper or a copper alloy powder.

12. A process according to claim 1, wherein the said powder is a stainless steel powder.

13. A process according to claim 4, wherein the reduction treatment is performed in the rotary tube by establishing therein at least two zones heated to different temperatures and by circulating a reducing gas mixture in countercurrent with the suspension and the bed.

* * * * *